United States Patent [19]

Waugh et al.

[11] 4,227,112

[45] Oct. 7, 1980

[54] GRADATED TARGET FOR X-RAY TUBES

[75] Inventors: John S. Waugh, Wellesley, Mass.; Martin Braun, San Jose, Calif.

[73] Assignee: The Machlett Laboratories, Inc., Stamford, Conn.

[21] Appl. No.: 962,443

[22] Filed: Nov. 20, 1978

[51] Int. Cl.[2] ..... H01J 35/10

[52] U.S. Cl. ..... 313/41; 313/60; 313/330

[58] Field of Search ..... 313/60, 330, 41

[56] References Cited

U.S. PATENT DOCUMENTS

| | | | |
|---|---|---|---|
| 2,863,083 | 12/1958 | Schram | 313/330 |
| 3,649,355 | 3/1972 | Hennig | 313/330 X |
| 3,662,210 | 5/1972 | Maximov | 313/330 X |
| 3,890,521 | 6/1975 | Shroff | 313/330 X |
| 3,936,689 | 2/1976 | Birjukova et al. | 313/330 |
| 3,969,131 | 7/1976 | Fatzer et al. | 313/330 X |
| 4,090,103 | 5/1978 | Machenschalk et al. | 313/330 |

FOREIGN PATENT DOCUMENTS

| | | | |
|---|---|---|---|
| 2334677 | 10/1974 | Fed. Rep. of Germany | 313/30 |

*Primary Examiner*—Harold A. Dixon
*Assistant Examiner*—Charles F. Roberts
*Attorney, Agent, or Firm*—John T. Meaney; Joseph D. Pannone

[57] ABSTRACT

An X-ray tube including a tubular envelope having therein an X-ray target comprised of a support body made of a first material and provided with a composite surface layer comprising a controlled gradient of a second material disposed in the first material, one of the materials being an X-ray emissive material and the other of the materials being a heat absorbent material, and an electron emitting cathode disposed to beam electrons onto a focal spot area of the composite surface layer.

14 Claims, 2 Drawing Figures

GRADATED TARGET FOR X-RAY TUBES

BACKGROUND OF THE INVENTION

1. Field of the Invention

This invention relates generally to X-ray tubes and is concerned more particularly with a rotatable X-ray target having focal track means for dissipating heat.

2. Discussion of the Prior Art

Generally, a rotating anode X-ray tube comprises a tubular envelope having therein an electron emitting cathode disposed to beam high energy electrons onto a spaced anode target. The target may comprise an axially rotatable disc having adjacent its outer periphery an annular focal track made of an efficient X-ray emitting material, such as tungsten, for example. Thus, electrons beamed from the cathode may be focused onto a focal spot area of the focal track to penetrate into the underlying material and generate X-rays which radiate therefrom and out of the tube.

Most of the electron energy incident on the focal spot area of the focal track is converted to heat energy which could become excessive and damage the surface of the focal track. Consequently, the target disc is rotated at a suitable high angular velocity, such as ten thousand revolutions per minute, for example, to move successive segments of the annular focal track rapidly through the focal spot area aligned with the electron beam. Thus, a one millimeter wide focal spot area on the focal track of a four inch diameter target disc would have successive segments of one millimeter width aligned with the electron beam for only about twenty microseconds, for example.

The penetration depth of an incident electron into the focal track material in the focal spot area is dependent upon the kinetic energy of the electron and the density of the focal track material. Consequently, when the focal track is made of relatively high density material, such as tungsten, for example, the incident electrons penetrate into only a thin layer of the focal track material adjacent the bombarded surface thereof. Thus, electrons having respective energies of about eighty thousand electron volts penetrate into tungsten material to a depth of only about five micrometers, for example.

As a result, the focal track may comprise a thin layer of high density material, such as tungsten-rhenium alloy, for example, disposed annularly on the electron bombarded surface portion of a rotatable disc made of relatively low density material, such as graphite, for example. Thus, the low density material of the substrate disc reduces the inertia of the target and aids in attaining the desired high angular velocity in a relatively shorter time interval, as compared to a disc made of high density material, such as tungsten, for example. Also, the layer of high density material may be provided with an optimum thinness for the low density material of the disc to function as an efficient heat sink in dissipating heat from the focal spot area of the focal track.

However, it has been found difficult to provide a reliable X-ray target having a thin layer of high density material deposited on a disc of low density material. Unless the deposition process is carefully controlled, peel-off and other deteriorating effects may be caused by the thermomechanical stresses developed in rotating anode targets. Also, the sudden transition from the high density material of the layer to the low density material of the disc may cause fracture to occur at the sharp interface.

Therefore, it is advantageous and desirable to provide an X-ray tube with a rotating anode having focal track means for dissipating heat from the focal spot area and avoiding the thermomechanical difficulties encountered in similar tubes of the prior art.

SUMMARY OF THE INVENTION

Accordingly, this invention provides an X-ray tube including a tubular envelope having therein an X-ray target comprising a support body made of a first material and provided with a composite surface layer wherein a controlled gradient of a second material is disposed in the first material. One of the materials in the composite surface layer is a heat absorbent material; and the other material is an X-ray emissive material. An electron emitting cathode is disposed to beam high energy electrons onto a focal spot area of the composite surface layer aligned with an X-ray transparent window in the tube envelope. As a result, the beamed electrons penetrate into the gradient structure of the composite surface layer to generate X-rays, which radiate from the focal spot area and pass in a beam through the X-ray transparent window of the tube. Thus, the composite surface layer of the X-ray target avoids the risk of peel-off and other deteriorating effects, such as fracture at a sharp interface, for example, which occur in X-ray tubes of the prior art.

The heat absorbent material of the composite surface layer has a relatively lower density than the X-ray emissive material to permit passage of the beamed electrons through it. Also, the heat absorbent material provides means for conducting the resulting heat away from the focal spot area instantaneously. Consequently, the heat absorbent material preferably comprises one or more elemental components having respective atomic numbers no greater than thirty, such as beryllium, boron, carbon, or alloys thereof, for examples. Also, the X-ray emissive material preferably comprises one or more elemental components having respective atomic numbers greater than the atomic numbers of the elemental components of the heat absorbent material, such as molybdenum, tungsten, or rhenium, for examples. The gradient of one material in the other material of the composite surface layer may be provided by controllably diffusing said one material into a target support body made of the other material. The resulting composite surface layer preferably has a thickness between two and sixty micrometers.

Thus, the X-ray target of this invention may comprise a support body made of heat absorbent material, such as graphite, for example, and provided with a composite surface layer wherein a controlled gradient of X-ray emissive material, such as rhenium, is disposed in the heat absorbent material. The concentration of X-ray emissive material may have a maximum value, such as one hundred percent, for example, at the surface of the composite layer and decrease progressively as a function of depth in the layer. Accordingly, the composite layer may be provided with a desired concentration of X-ray emissive material at a preferred depth in the layer, such as a thirty percent concentration of X-ray emissive material at fifty percent of the electron penetration depth in rhenium, for example. Preferably, the gradient of X-ray emissive material in the heat absorbent material extends to a depth less than the maximum penetration depth of the beamed electrons. As a result, only a portion of the electrons will expend their energies in the composite surface layer. The remaining portion of the beamed electrons will penetrate relatively deeper into the graphite material than they would into the rhenium material, and dissipate their residual energies in a comparatively larger volume of the heat absorbent material.

Alternatively, the X-ray target of this invention may comprise a support body made of X-ray emissive material, such as rhenium, for example, and provided with a composite surface layer wherein a controlled gradient of heat absorbent material, such as graphite, for example, is disposed in the X-ray emissive material. The concentration of heat absorbent material may have a maximum value, such as one hundred percent, for example, at the surface of the composite layer and decrease progressively as a function of depth in the layer. Accordingly, the composite layer may be provided with a desired concentration of heat absorbent material at a preferred depth in the layer, such as fifty percent concentration at seventy percent of the electron penetration depth in carbon, for example. Thus, the beamed electrons expend their energies in a larger volume of the composite layer than in rheniun material. Furthermore, the graphite material provides means for conducting the resulting heat away from the surface of the composite material in the focal spot area, in addition to the heat diffusing away therefrom through the body of the target. As a result, the X-ray target of this invention may operate at a lower temperature or at a higher instantaneous loading as compared to X-ray targets of the prior art.

BRIEF DESCRIPTION OF THE DRAWINGS

For a better understanding of the invention, reference is made in the following more detailed description to the accompanying drawings wherein.

DESCRIPTION OF THE PREFERRED EMBODIMENT

Figure 1:
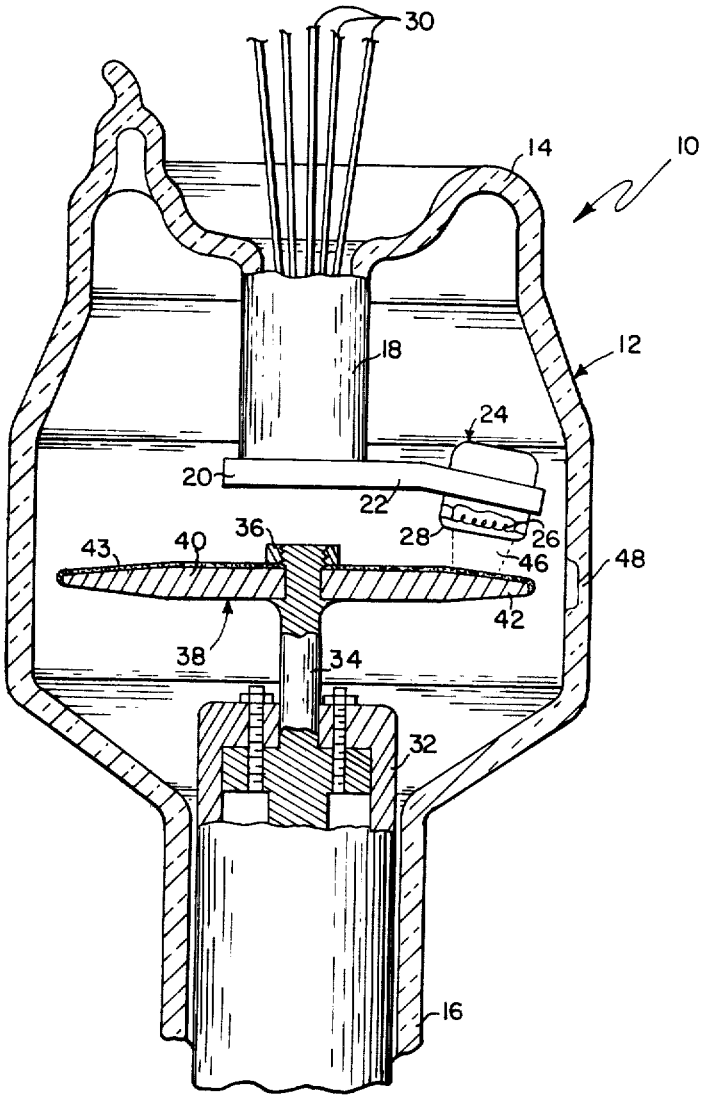
FIG. 1 is a fragmentary elevational view, partly in section, of a rotating anode X-ray tube embodying the invention.

Referring to the drawing wherein like characters of reference designate like parts, there is shown in FIG. 1 an X-ray tube 10 of the rotating anode type having a tubular envelope 12 made of dielectric material, such as glass, for example. Envelope 12 is provided with a reentrant end portion 14 and an opposing neck portion 16. The reentrant end portion of envelope 12 is peripherally sealed to one end of a cathode support sleeve 18 made of rigid material, such as Kovar, for example. Cathode sleeve 18 extends axially within the envelope 12 and has an inner end hermetically sealed to a cap 20 which supports a radially extending, hollow arm 22.

The arm 22 is angulated with respect to the axis of cathode sleeve 18 and supports on a distal end portion thereof a conventional cathode head 24. Cathode head 24 generally includes an electron emitting filament 26 which is longitudinally disposed within a grid-type focusing cup 28. Electrical conductors 30 extend hermetically through the cap 20 and insulatingly through the hollow arm 22 for suitable connection to the filament 26 and the focusing cup 28 in a well-known manner.

Sealed within the neck portion 16 of envelope 12 is a bearing mounted rotor 32 of a magnetic-type induction motor, (the external stator of which is not shown). The rotor 32 extends axially within envelope 12 and has attached to its inner end an axially extending stem 34. Suitably secured, as by hex nut 36, for example, to a distal end portion of stem 34 is a transversely disposed anode target 38, which is rotated by the rotor 32 in a well-known manner.

Figure 2:
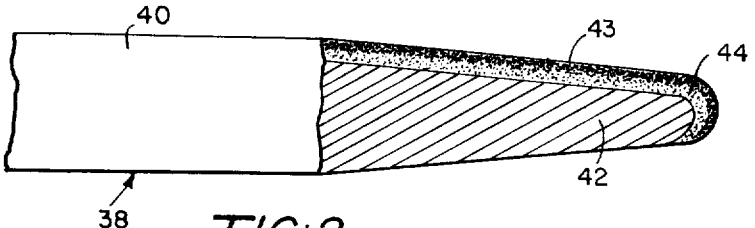
FIG. 2 is an enlarged fragmentary elevational view, partly in section, of the rotating anode shown in FIG. 1.

The anode target 38 includes a substrate disc 40 having adjacent its outer periphery an annular focal track portion 42 provided with a sloped surface 43 adjacent the cathode 24. Disc 40 is made of a high capacity, heat absorbent material comprising one or more elements having respective atomic numbers no greater than thirty, such as graphite, for example. As shown in FIG. 2, the sloped surface 43 overlies a thin composite layer 44 made of the graphite material of disc 40 and an X-ray emissive material comprising one or more elements having respective atomic numbers greater than thirty, such as rhenium, for example.

The X-ray emissive material is disposed within the heat absorbent material as a controlled gradient having a maximum concentration of the X-ray emissive material adjacent the surface 43. Thus, rhenium material may be deposited on the sloped surface 43 of focal track portion 42 by suitable means, such as chemical vapor deposition or metallic spraying techniques, for examples. Then, the disc 40 may be heated in a controlled atmosphere, such as a substantially vacuum or inert gas environment, for examples, to a preselected temperature, such as greater than twenty-five hundred degrees Centigrade, for example, for a predetermined interval of time. As a result, the rhenium material, which does not unite chemically with the graphite material, diffuses into the layer 44 at a rate dependent upon the temperature and heating interval selected. Thus, the diffusion process may be carefully controlled to provide a desired gradient of the high density rhenium material having a maximum concentration adjacent the surface 43 and progressively decreasing concentrations with increasing depth in the layer 44.

In operation, electrical energy supplied through the conductors 30 heats the filament 26 to an electron emitting temperature, and maintains the focusing cup 28 at a suitable electrical potential for directing the emitted electrons into a beam 46. Electron beam 46 impinges on a focal spot area of suitable size, such as one millimeter by five millimeters, for example, on the composite surface layer 44 of focal track portion 42. The anode target disc 38 may be of conventional size, such as four inches in diameter, for example, and is rotated at an appropriately high angular velocity, such as ten thousand revolutions per minute, for example. As a result, successive one millimeter wide segments of the surface layer 44 move rapidly through the focal spot area aligned with the electron beam 46. Also, the anode target disc 38 is maintained at a sufficiently high electrical potential with respect to the cathode filament 26 to accelerate electrons in the beam 46 to high kinetic energy levels. Consequently, electrons in the beam 46 penetrate into the composite layer 44 and generate X-rays through interaction with atoms of the X-ray emissive material gradiently disposed therein. Thus, generated X-rays emanate from the focal spot area of layer 44 and pass in a beam (not shown) through a radially aligned, X-ray transparent window 48 in the envelope 12.

It can be shown that the electron penetration depth in any target material is dependent on the electron energy level and the density of the target material. Consequently, when the target is made of a material, comprising one or more elements having respective atomic numbers greater than seventy, for example, electrons at conventional energy levels penetrate therein to depths less than twenty micrometers. Accordingly, the composite surface layer 44 may conveniently be provided with a total thickness between two and twenty micrometer. Further, most of the X-rays emanating from the focal spot area of layer 44 are generated in strata adjacent the sloped surface 43, such as within a depth equivalent to twenty-five percent of the electron penetration in rhenium, for example. Therefore, the gradient of rhenium material in layer 44 advantageously may be provided with a concentration which is approximately one hundred percent at the surface 43 and decreases progressively to a desired lower value at a predetermined depth in layer 44. Thus, the concentration of rhenium in layer 44 may decrease to a value of about thirty percent at a depth equivalent to fifty percent of the electron penetration range in a sample of rhenium material, for example. However, these concentration values for the gradient of X-ray emissive material in layer 44 are dependent on the respective densities of the materials in layer 44, the rotating speed of target disc 40, and the electron accelerating voltage applied between the anode target 38 and the cathode filament 26.

Accordingly, only a portion of the beamed electrons, such as less than fifty percent, for example, are stopped within a bombarded segment of the layer 44. The remaining portion of the beamed electrons penetrate into the underlying graphite material of disc 40. Since the graphite material has a much lower density than the rhenium material of layer 44, these deeper penetrating electrons pass through a larger volume of the graphite material than they would if the target were made solely of rhenium. Consequently, the deeper penetrating electrons have their kinetic energies converted to heat in a relatively large volume of graphite material which has excellent thermal characteristics. Thus, the relatively large volume of graphite material provides means for storing the heat developed therein during electron bombardment of the overlying segment of layer 44. Also, the graphite material provides means for conducting the developed heat to other portions of target 38 when the bombarded segment of layer 44 is not in alignment with the electron beam 46.

Since the heat dissipation capability of target 38 is increased in comparison to prior art targets having a focal track layer of X-ray emissive material on a substrate disc of lower density material, the electron current beamed from cathode 24 may be increased correspondingly. As a result, it may be found that the accompanying increase in X-ray generation more than compensates for the lower X-ray yield obtained from the composite layer 44, as compared to the X-ray yield from prior art targets having a focal track layer made of rhenium alone. Furthermore, the graphite material of layer 44 provides low density means for permitting a portion of the beamed electrons to pass through a bombarded segment of layer 44 and have their residual energies converted to heat in a relatively large volume of graphite material. Since the electron penetration depth in graphite is large compared to the heat diffusion path therein during electron bombardment, the instantaneous power rating of the tube may be increased correspondingly.

Alternatively, the disc 40 may be made of an X-ray emissive material comprising one or more elements having respective atomic numbers greater than thirty, such as rhenium, for example. Accordingly, the composite layer 44 may include a heat absorbent material comprising one or more elements having respective atomic numbers no greater than thirty, such as graphite, for example, and disposed as a controlled gradient within the X-ray emissive matrix material. The graphite material may be deposited on the sloped surface 43 of focal track portion 42 by suitable means, such as chemical vapor deposition, for example. Then, the disc 40 may be heated in a controlled atmosphere, such as a substantially vacuum or inert gas environment, for examples, to a preselected temperature, such as greater than twenty-five hundred degrees Centigrade, for example, for a predetermined interval of time. As a result, the graphite material will diffuse into the layer 44 of rhenium material at a rate dependent upon the temperature and heating interval selected. Thus, the diffusion process may be carefully controlled to provide a desired gradient of the graphite material in the rhenium matrix material of layer 44.

The gradient of graphite material may be diffused in the rhenium material of layer 44 to have a maximum concentration, such as one hundred percent, for example, adjacent the surface 43 and a decreasing concentration with increasing depth in the layer 44. Accordingly, the concentration of graphite material may decrease from the surface 43 to a desired value at a predetermined depth in the composite layer 44, such as seventy percent concentration at fifty percent of the electron penetration depth in graphite, for example. As a result, the composite layer 44 will be provided with a surface strata of heat absorbent material which will permit the heat developed in the focal spot area to be conducted away therefrom in two directions, namely into the overlying graphite material of layer 44 and into the underlying rhenium material of disc 40. Also, the lower density of graphite material permits a deeper penetration of the beamed electrons and a greater thickness, such as sixty micrometers, for example, of the layer 44. As a result, the beamed electrons will expend their energies in a greater volume of the layer 44 than would be the case if the layer 44 were made solely of rhenium. Consequently, the X-ray target disc 40 will operate at a lower temperature in the focal spot area or will operate at a higher instantaneous power rating than similar rotating anode X-ray tubes of the prior art.

Thus, there has been disclosed herein an X-ray tube including tubular envelope wherein an X-ray target is provided with a focal track portion having a thin composite surface layer comprising either an X-ray emissive material gradiently disposed in a matrix of heat absorbent material, or a heat absorbent material gradiently disposed in a matrix of X-ray emissive material. Although the composite surface layer has been shown as underlying the sloped surface 43 of focal track portion 42, it equally well may underlie the entire surface of target disc 40 to avoid masking during the deposition process.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. An X-ray target including:

a support body having a surface overlying a composite layer comprising a first material and a controlled gradient of a second material disposed therein, one of the materials being a heat absorbent material comprised of one or more elemental components having respective atomic numbers no greater than thirty and the other of the materials being an X-ray emissive material comprised of one or more elemental components having respective atomic numbers greater than the atomic numbers of the elemental components of said one of the materials.

2. An X-ray target as set forth in claim 1 wherein the first material is a heat absorbent material comprising one or more elemental components having respective atomic numbers no greater than thirty; and the second material is an X-ray emissive material comprising one or more elemental components having respective atomic numbers greater than the atomic numbers of the elemental components of the first material.

3. An X-ray target as set forth in claim 1 wherein the first material is an X-ray emissive material comprising one or more elemental components having respective atomic numbers greater than thirty; and the second material is a heat absorbent material comprising one or more elemental components having respective atomic numbers less than the atomic numbers of the elemental components of the first material.

4. An X-ray target as set forth in claim 1 wherein the composite layer has a thickness between two and sixty micrometers as measured from the surface.

5. An X-ray target as set forth in claim 2 wherein the composite layer has a thickness between about two and twenty micrometers as measured from the surface.

6. An X-ray target as set forth in claim 1 wherein the second material has a maximum concentration adjacent the surface and a progressively decreasing concentration as a function of depth from the surface.

7. An X-ray target as set forth in claim 6 wherein the concentration of the second material is approximately one hundred percent at the surface and decreases progressively to a desired concentration at a predetermined depth from the surface.

8. An X-ray target as set forth in claim 1 wherein the support body is made of the first material.

9. An X-ray tube including:

a tubular envelope;

an X-ray target rotatably mounted in the envelope and having an annular focal track surface overlying a composite layer comprising a first material and a controlled gradient of a second material disposed therein, one of the materials being a heat absorbent material comprised of one or more elemental components having respective atomic numbers no greater than thirty and the other of the materials being an X-ray emissive material comprised of one or more elemental components having respective atomic numbers greater than the atomic numbers of the elemental components of said one of the materials; and means for beaming electrons into the composite layer and generating X-rays which pass in a beam out of the tube.

10. An X-ray tube as set forth in claim 9 wherein the first material is a heat absorbent material comprising one or more elemental components having respective atomic numbers no greater than thirty; and the second material is an X-ray emissive material comprising one or more elemental components having respective atomic numbers greater than the atomic numbers of the elemental components of the first material.

11. An X-ray tube as set forth in claim 9 wherein the first material is an X-ray emissive material comprising one or more elemental components having respective atomic numbers greater than thirty; and the second material is a heat absorbent material comprising one or more elemental components having respective atomic numbers less than the atomic numbers of the elemental components of the first material.

12. An X-ray tube as set forth in claim 9 wherein the target is made of the first material; and the second material has a maximum concentration adjacent the focal track surface.

13. An X-ray tube as set forth in claim 12 wherein the concentration of second material is approximately one hundred percent at the focal track surface and decreases progressively as a function of depth measured from the surface.

14. An X-ray tube as set forth in claim 13 wherein the composite layer has a thickness between two and sixty micrometers measured from the focal track surface.

* * * * *